United States Patent [19]

Huckaby

[11] 4,157,117

[45] Jun. 5, 1979

[54] OIL WELL TUBE DRAINING METHOD AND MEANS

[76] Inventor: Leonard Huckaby, P.O. Box 152, Wayne, Okla. 73095

[21] Appl. No.: 942,745

[22] Filed: Sep. 15, 1978

[51] Int. Cl.[2] ..... E21B 43/00; F04B 21/00

[52] U.S. Cl. ..... 166/311; 166/315; 417/434

[58] Field of Search ..... 417/434, 554; 166/311, 166/315, 314, 68, 105, 107, 110, 112

[56] References Cited

U.S. PATENT DOCUMENTS

| | | | |
|---|---|---|---|
| 2,501,237 | 3/1950 | Sanders | 417/434 X |
| 3,168,873 | 2/1965 | Huckaby | 417/434 |
| 4,047,853 | 9/1977 | Huckaby | 417/434 |

*Primary Examiner*—Stephen J. Novosad
*Attorney, Agent, or Firm*—Ralph B. Pastoriza

[57] ABSTRACT

A simplified means for draining oil well tubing to equalize the hydrostatic pressure of oil pumped up through the tubing with the oil in the annulus defined between the exterior of the tubing and the well casing is provided. Essentially, the pump barrel is extended beyond the lowermost point of reciprocation of the plunger in the barrel. A perforation is provided in the extended portion for communication between the well annulus and the interior of the extended portion. The polish rod connecting sucker rods to the plunger in the barrel in turn is treated to decrease its cross sectional area over a given length. This treated section of the polish rod is above the upper end of the pump barrel when the plunger is at its lowermost reciprocable position while pumping so that pumping operations can be carried out normally. When it is desired to dump the oil in the tubing to equalize the hydrostatic pressure, the plunger is lowered further than the lowermost point of reciprocation into the extended portion of the barrel by means of the sucker rods to bring the decreased cross sectional portion of the polish rod into a position partly extending into the pump barrel and partly above the pump barrel so that oil in the tubing can bypass the upper standing valve of the pump along the treated section of the polish rod to enter the barrel and extended portion and thence into the annulus.

6 Claims, 5 Drawing Figures

OIL WELL TUBE DRAINING METHOD AND MEANS

This invention relates generally to oil well pumping operations and more particularly to a method and means for draining oil pumped up in the tubing to the oil well annulus to thereby equalize the hydrostatic pressure. This operation is sometimes referred to as hydraulic unloading or "dumping".

BACKGROUND OF THE INVENTION

In order to pump oil from a well in which casing has been set, the casing is perforated by a suitable gun at those levels at which oil has been indicated to exist. After the casing has been perforated, a pump is lowered on the end of the conventional drill pipe string to this particular level. The pump includes a pumping tube hereafter referred to as a pump barrel within which a reciprocating plunger operates. This plunger is driven by a polish rod extending upwardly through the tubing to connect to the end of sucker rods which pass up through the drill pipe string to the surface of the well. The term "oil well tubing" as used herein is meant to include the pipe string and pump barrel. Oil is pumped from the lower annulus adjacent the perforations in the casing through the well tubing to the surface of the well.

After pumping has been completed, or if it is desired to change the pump or repair it, it is necessary to pull the tubing to bring the pump to the surface. Since, however, the oil well tubing is filled with oil throughout the length of the tubing including the pipe string, whereas the surrounding oil in the well annulus defined between the exterior of the well tubing and interior of the casing is at a relatively low level, there exists a very large pressure differential rendering it extremely difficult to pull the tubing.

The foregoing condition can be overcome if the fluid or oil within the well tubing could be passed in a reverse direction to the annulus exterior of the well tubing. If the fluid could be passed in this manner, the large hydrostatic head created within the well tubing could be "dumped" into the surrounding annulus of the well and thus equalize the pressures involved so that removal of the tubing without the large hydrostatic head of oil could be readily achieved.

My U.S. Pat. Nos. 3,168,873 issued Feb. 9, 1965 and 4,047,853 issued Sept. 13, 1977 disclose hydraulic unloading and circulating devices which solve the foregoing problem. However, the solutions described in these patents are not suitable for certain types of oil well pumps.

More particularly, there has been introduced an improved type of oil well pump capable of delivering a greater capacity of oil through a pipe string than previously available pumps. One such improved type pump is provided by the Heavy Oil Producer Service, Inc. referred to in the art as HOPS type pumps. Pumps of this type include a relatively large diameter pump tube which connects to the extreme end of the drill pipe string rather than being received within the drill pipe string. For such a pump, it would be desirable to incorporate some type of hydraulic unloading or pressure equalizing means in or as a part of the pump barrel itself. Further, a desirable feature is to be able to operate the "dumping" or equalizing system from the surface of the bore hole. Moreover, such system should be designed so that it will provide continuous communication between the interior of the oil well tubing and the annulus while pulling the tubing. would be provision of such a hydrostatic equalizing means which could be incorporated in the newer type referred to pumps with a minimum of structural modification, all to the end that overall economy is realized in the manufacture and use of the device.

BRIEF DESCRIPTION OF THE INVENTION

Bearing the foregoing in mind, the present invention contemplates an improved method and means for draining oil well tubing particularly applicable to pumps of the HOPS type which can be readily provided with a minimum of modification of the pump itself and which can further be operated from the surface of the well to equalize hydraulic fluid pressure on the inside and outside of the oil well tubing.

Briefly, the method involves providing an effective extension of the pump barrel below the lowermost point of reciprocation of the plunger in the barrel. A communication is provided between the interior of this effective extension and the well annulus. The polish rod for the plunger, in turn, is treated along a section normally above the pump barrel when the plunger is at its lowermost pumping position to decrease the cross sectional area of the polish rod. This treating of the polish rod will not affect normal pumping operations since the treated section does not enter the pump barrel during normal pumping.

To dump the oil in the tubing, the polish rod and plunger are lowered beyond the normal lowermost point of reciprocation by means of the sucker rods to move the plunger into the effective extension of the pump barrel below the communication provided between the interior of the extended portion of the pump barrel and the annulus. This movement of the plunger results in the positioning of the treated polish rod section so that part of the section extends into the pump barrel and the other part extends above the pump barrel. Essentially, the treated section "straddles" the standing valve in the pump barrel so that oil within the tubing can now pass along the treated section of the polish rod into the pump barrel and into the extended portion thereof out the communication opening to the annulus thereby equalizing the hydrostatic pressures.

The plunger and polish rod may remain in this lower moved position while pulling the pipe so that continuous communication is provided between the interior of the oil well tubing and the annulus. Moreover, since the "dumping" operation is accomplished by simply lowering the plunger and polish rod beyond its normal amplitude limits of reciprocation, the operation can readily be carried out from the surface of the well.

BRIEF DESCRIPTION OF THE DRAWINGS

A better understanding of the method and means of this invention will be had by referring to the accompanying drawings in which.

DETAILED DESCRIPTION OF THE PREFERRED EMBODIMENT

Figure 1:
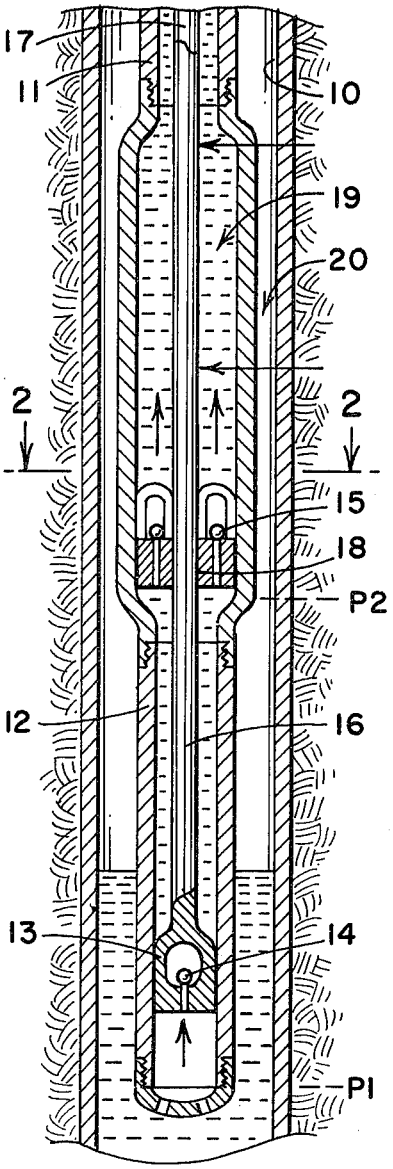
PRIOR ART FIG. 1
FIG. 1 is a simplified fragmentary cross section of the lower end of an oil well tubing showing a typical pump secured to the end of the oil well pipe string.

Referring first to FIG. 1 there is shown the lower portion of an oil well casing 10 within which there is illustrated well tubing including a pipe string 11 supporting at its lower end a pump barrel 12. It will be understood in FIG. 1 that the pipe string 11 at the upper portion of the drawing may extend for several thousand feet upwardly in the well casing 10.

Within the pump barrel 12 there is mounted for reciprocation a plunger 13 incorporating a travelling check valve 14. At the upper end of the pump barrel 12 is a fixed check valve 15, sometimes referred to in the art as "a standing check valve". These check valves will pass oil only in an upward direction as indicated by the small arrows.

Plunger 13 is reciprocated within the pump barrel 12 by means of a polish rod 16 connected to sucker rods, the lowermost one of which is illustrated at the top of FIG. 1 at 17. These sucker rods pass through the pipe string 11 to the surface of the oil well and are moved up and down by the usual "horse's head".

Normally, the polish rod 16 passes in sealng relationship through the standing valve structure, there being provided a suitable sealing or stuffing at 18.

Oil in the lower end of the well casing can pass upwardly through an appropriate basket or filter at the end of the barrel 12 through the travelling valve 14 when the plunger 13 is moving downwardly. When the plunger 13 moves upwardly in the barrel 12, the oil is lifted to flow through the standing or fixed valve 15 into the well tubing as indicated at 19.

As described briefly heretofore, when it is desired to pull the well tubing to replace the pump or repair the same or for any other reason, it is first desirable to equalize the hydrostatic pressure between the oil 19 in the tubing extending to the surface and the oil in the well annulus between the exterior of the tubing and the interior of the casing 10. This annulus is indicated by the arrow 20.

Figure 2:
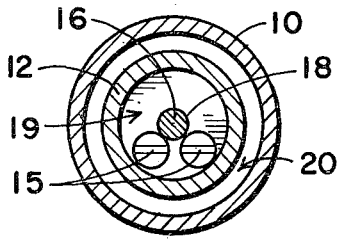
FIG. 2 is a cross section taken in the direction of the arrows 2—2 of FIG. 1.

FIG. 2 illustrates the standing valve 15 wherein the portion of the valve body through which the polish rod 16 passes is indicated, the sealing or stuffing being indicated at 18. Two check valves are shown at 15 so that maximum oil flow can take place.

Figure 3:
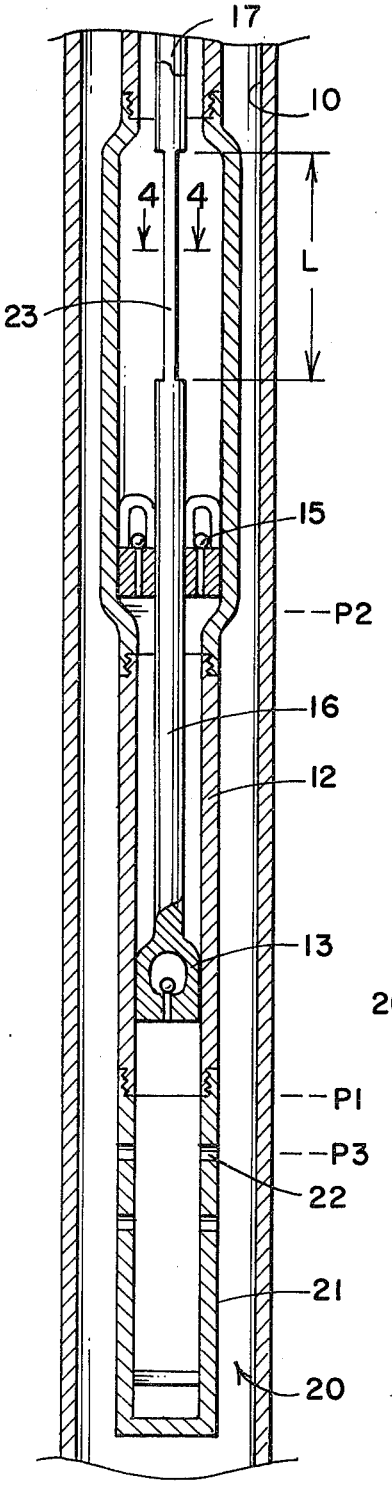
FIG. 3 is a view similar to FIG. 1 showing modifications of the structure of FIG. 1 to allow for hydrostatic equalization in accord with the method of this invention.

Referring now to FIG. 3, the manner in which the hydrostatic pressure of the oil 19 in the well tubing is equalized with the oil in the annulus 20 in accord with the present invention will be evident. First, the pump barrel 12 is modified by providing an effective extension thereof. This extension is threadedly secured to the lower end of the pump barrel in place of the filter at the extreme bottom of the pump barrel 12 shown in FIG. 1. The connection of the extension which might constitute a nipple is at a point P1 which corresponds to the lowestmost point of reciprocation of the plunger 13 in normal pumping operations. The upper point of reciprocation corresponds to the position of the fixed or standing check valve 15 described in FIG. 1 and is designated P2. Thus, the normal reciprocation of the plunger 13 takes place between the first lower point P1 and the second upper point P2.

A means for providing communication between the interior of the effective extension 21 and the annulus 20 is provided as by means of perforations such as indicated at 22. This communication means or perforation is at a point P3 below the point P1.

Referring now to the upper portion of FIG. 3, the polish rod 16 is treated along a section of length L indicated at 23. Treating of the polish rod effectively decreases its cross sectional area along this length. The treated section 23 is above the upper end of the pump barrel and the fixed valve 15 when the plunger 13 is at its lowermost point P1. In other words, the treated section 23 will always remain above the fixed valve 15 during normal reciprocating movements of the plunger between the points P1 and P2 so that a seal between the polish rod 16 and the valve body is maintained.

Figure 4:
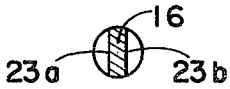
FIG. 4 is a cross section taken in the direction of the arrows 4—4 of FIG. 3.

Referring to the cross section of FIG. 4, it will be seen that in the particular embodiment illustrated, the treating of the polish rod to decrease its cross sectional area takes the form of milling out diametrically opposite side wall portions along the length L to leave flats 23*a* and 23*b*.

Figure 5:
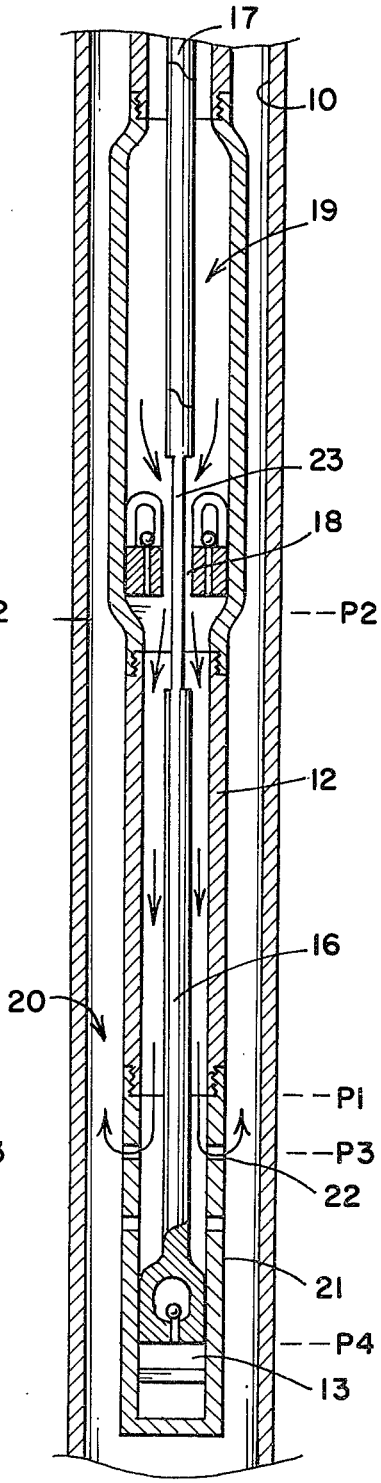
FIG. 5 is a cross section similar to FIG. 3 but illustrating the position of various components during a "dumping" operation.

Referring now to FIG. 5, there is illustrated the manner in which "dumping" of oil in the well tubing is accomplished. As is shown, this "dumping" is effected by simply lowering the plunger 13 by means of the polish rod 16 and sucker rods 17 beyond the lowestmost point of reciprocation P1 into the extended portion or nipple 21 to a fourth point P4 below the point P3. When the plunger 13 is moved by the polish rod 16 to this position illustrated in FIG. 5, the treated section 23 then extends partly within the pump barrel 12 and partly above the pump barrel to effectively straddle the second point P2 or the fixed second check valve 18. As a consequence, oil can now flow from the interior of the tubing 19 along the treated section 23 to pass into the barrel 12 and thence into the extended portion 21 and out the communication perforation 22 to the annulus 20.

So long as the plunger 13 and polish rod 16 are retained in the position illustrated in FIG. 5 there will thus be provided the desired communication between the oil in the oil well tubing and the annulus so that the hydrostatic pressure is equalized and the tubing can be pulled.

It can now be appreciated from the foregoing, that the "dumping" can readily be accomplished in many presently available pumps with a minimum of modification. All that is really necessary is to provide an effective extension of the pump barrel together with an appropriate communication means between the interior of the extension and the well annulus. Then, it is only necessary to treat a section of the polish rod as described so that when the plunger is lowered into the extended portion, the treated section of the polish rod will permit oil to bypass the standing valve 18, all as described in conjunction with FIG. 5 and as indicated by the arrows.

In some instances, the modification in providing the extended portion of the barrel 12 can be accomplished by simply interchanging the normally provided clutch collar on the lower end portion of the pump barrel with the extreme lower end collar on the barrel, this action permitting the plunger to be moved downwardly beyond its normal reciprocating point. Perforations would then be provided in the pump barrel below the position previously occupied by the clutch collar. Alternatively, a simple nipple extension can be provided as described.

An additional advantage of the present invention aside from permitting hydrostatic equalization is the ability to drain the oil in the tubing should there occur a failure in the sucker rods. For example, small amounts of sand present in the oil can settle back on the pump thereby sometimes stopping the pump and requiring a stripping job. Or, a failure in the rods can result in the polish rod simply dropping beyond its lowestmost point during normal pumping. In either event, the tubing is easily drained by pushing the pump plunger to the lower fourth point referred to, in the first case, or automatically in the second case when the rods break.

From all of the foregoing, it will thus be evident that the present invention has provided a simplified method and means for equalizing the hydrostatic pressure in oil well tubing with the oil in the well annulus, preparatory to pulling the tubing.

I claim:

1. A method for draining an oil well tubing including a pipe string and pump barrel at the lower end of the pipe string, to equalize the hydrostatic pressure of oil pumped up through said tubing and the oil in the annulus defined between the exterior of the tubing and the well casing, and wherein a polish rod on the end of sucker rods in the pipe string is provided for reciprocating a pump plunger in said pump barrel between a first lower point and a second upper point, including the steps of:

(a) extending the effective length of the pump barrel;

(b) providing communication between the interior of the effective extended length of the pump barrel and said annulus at a third point below said first point;

(c) treating a section of said polish rod above said second point when said plunger is at said first point to decrease its cross sectional area along said section;

(d) lowering said plunger into the effective extended length of the pump barrel beyond said third point to a fourth point, the treated section of said polish rod being formed on the rod in a position such that it straddles said upper second point extending partly into said pump barrel and partly above said pump barrel when said plunger is at said fourth point so that oil in said tubing can pass into said pump barrel along said section of polish rod and out said communication to said annulus thereby equalizing said hydrostatic pressure.

2. The method of claim 1, in which said step of treating said polish rod comprises removing material from diametrically opposite sides over the length of said section to leave flats.

3. The method of claim 1, in which said step of extending the effective length of the pump barrel comprises adding a nipple to the end of said pump barrel, said step of providing communication comprising providing a perforation in the side wall of said nipple at said third point.

4. In an oil well tubing including a pipe string and pump barrel at the lower end of the pipe string having a plunger reciprocable between a first lower point in said barrel and a second upper point in said barrel and wherein said plunger incorporates a first travelling check valve and said barrel includes a second fixed check valve at said second point said first and second check valves passing oil only in an upward direction, and further wherein there is provided a polish rod on the end of sucker rods in said pipe string for reciprocating said plunger, means for draining said tubing to equalize the hydrostatic pressure of oil pumped up through said tubing and the oil in the annulus defined between the exterior of said tubing and the well casing, including, in combination:

(a) means defining an effective extension of said pump barrel;

(b) means in said effective extension at a third point below said first point providing communication between the interior of said effective extension and said well annulus; and (c) means on said polish rod positioned above said second point when said plunger is at said first point, decreasing the cross sectional area of said polish rod along a section of given length sufficient so that when said plunger is lowered by said sucker rods into said effective extension below said third point, said section straddles said fixed check valve to thereby permit oil in said tubing to drain through said section of said polish rod into said barrel and effective extension thereof to pass out said means providing communication to said annulus.

5. The subject matter of claim 4, in which said means defining an effective extension of said pump barrel comprises a nipple threadedly secured to the lower end of said pump barrel, and said means providing communication comprising at least one perforation in the side wall of said nipple at said third point.

6. The subject matter of claim 4, in which said means on said polish rod decreasing the cross sectional area of said polish rod comprises flats on diametrically opposite side walls of the polish rod along the length of said section formed by milling out material of said side walls.

* * * * *